US010553352B2

(12) United States Patent
Kwok et al.

(10) Patent No.: US 10,553,352 B2
(45) Date of Patent: Feb. 4, 2020

(54) CORROSION RESISTANT MAGNET ASSEMBLY

(71) Applicant: APPLE INC., Cupertino, CA (US)

(72) Inventors: Wai Man Raymund Kwok, Kowloon (HK); Melissa Wah, San Jose, CA (US)

(73) Assignee: Apple Inc., Cupertino, CA (US)

( * ) Notice: Subject to any disclaimer, the term of this patent is extended or adjusted under 35 U.S.C. 154(b) by 267 days.

(21) Appl. No.: 15/464,077

(22) Filed: Mar. 20, 2017

(65) Prior Publication Data

US 2017/0272864 A1 Sep. 21, 2017

Related U.S. Application Data

(60) Provisional application No. 62/310,453, filed on Mar. 18, 2016.

(51) Int. Cl.

| | |
|---|---|
| ***H01F 41/02*** | (2006.01) |
| ***H04R 9/06*** | (2006.01) |
| ***H01F 7/02*** | (2006.01) |
| ***H04R 9/02*** | (2006.01) |
| *H01F 27/23* | (2006.01) |

(52) U.S. Cl.

CPC ..... *H01F 41/026* (2013.01); *H01F 7/0221* (2013.01); *H04R 9/025* (2013.01); *H04R 9/06* (2013.01); *H01F 27/23* (2013.01); *H04R 2209/024* (2013.01); *H04R 2499/11* (2013.01)

(58) Field of Classification Search

None

See application file for complete search history.

(56) References Cited

U.S. PATENT DOCUMENTS

| | | | | |
|---|---|---|---|---|
| 4,959,273 | A * | 9/1990 | Hamamura | H01F 1/0577 419/7 |
| 5,275,891 | A * | 1/1994 | Tagaya | C23C 22/24 427/436 |
| 5,302,464 | A * | 4/1994 | Nomura | C25D 3/12 205/119 |
| 5,314,756 | A * | 5/1994 | Tagaya | H01F 41/026 428/546 |
| 9,905,345 | B2 * | 2/2018 | Sassaman | H01F 7/021 |
| 2011/0037549 | A1 * | 2/2011 | Miyao | C22C 9/00 335/302 |

(Continued)

FOREIGN PATENT DOCUMENTS

| | | | | |
|---|---|---|---|---|
| JP | 02083905 | A * | 3/1990 | |
| JP | 08003762 | A * | 1/1996 | H01F 41/026 |
| JP | 2009176880 | A * | 8/2009 | |

OTHER PUBLICATIONS

JP Abstract Translation of JP 02-083905 A (Year: 1990).*

(Continued)

*Primary Examiner* — Kevin M Bernatz

(74) *Attorney, Agent, or Firm* — Kilpatrick Townsend & Stockton LLP

(57) ABSTRACT

Embodiments of the disclosure pertain to methods of plating magnets with a stack of layers such that the resulting magnet assembly has improved corrosion resistance. Embodiments of the disclosure are also directed to magnet assemblies formed by such methods. Some embodiments include a High Phosphorus Electroless Nickel (HiPEN) layer with Phosphorus content greater than 11% by weight.

20 Claims, 13 Drawing Sheets

(56) References Cited

U.S. PATENT DOCUMENTS

| | | | | |
|---|---|---|---|---|
| 2014/0311291 | A1* | 10/2014 | Enokido | H01F 1/0536 75/246 |
| 2015/0161919 | A1* | 6/2015 | Lim | G09F 3/10 428/623 |
| 2016/0086754 | A1* | 3/2016 | Shimoda | H01H 50/28 335/2 |

OTHER PUBLICATIONS

JP Abstract Translation of JP 2009-176880 A (Year: 2009).*
Machine Translation of JP 2009-176880 A (Year: 2009).*
JP Abstract Translation of JP 08-003762 A (Year: 1996).*
Machine Translation of JP 08-003762 A (Year: 1996).*

* cited by examiner

CORROSION RESISTANT MAGNET ASSEMBLY

CROSS-REFERENCE TO RELATED APPLICATIONS

This application claims priority to U.S. Provisional Patent Application No. 62/310,453, filed Mar. 18, 2016, and entitled "CORROSION RESISTANT MAGNET ASSEMBLY AND METHOD OF MAKING THE SAME", which is herein incorporated by reference in its entirety.

FIELD

The present disclosure relates generally to corrosion resistant coatings.

BACKGROUND

Receiver magnets are used in phone receivers, including in mobile phone receivers. The receiver magnet can be used to drive the coils to make the receiver work, thereby operating a speaker in the phone. Receiver magnets can be prone to corrosion that can result in degraded acoustic performance, for example, because of changed size and properties of the magnet itself, and/or because of smaller particles formed as the magnet corrodes. These particles can interfere with other components in the receiver, such as the coils, as they move. This can, for example, produce an undesirable "hissing" noise at the speakers or otherwise degrade audio quality. Hence, there is a need for receiver magnets to be corrosion resistant. Other magnets including rare earth magnets, used in acoustic or other applications, can also benefit from corrosion resistant properties. Corrosion resistant coatings can also be useful in other applications such as electrical contacts.

SUMMARY

Embodiments of the disclosure pertain to methods of plating magnets with a stack of layers such that the resulting magnet assembly has improved corrosion resistance. While some embodiments of the disclosure are particularly useful for improving corrosion resistance of receiver magnets while maintaining the receiver acoustic and drop performance, other embodiments can beneficially improve the corrosion resistance of magnets used in other applications or improve the corrosion resistance of other structures, such as electrical contacts. Embodiments also pertain to assemblies formed by such methods.

In some embodiments, a multi-layer stack of different materials is formed over a rare earth magnet (e.g. NdFeB) core. The multi-layer stack can include one or more layers having properties tailored to act as a barrier layer, a catalyst, a scratch protection layer, a passivation layer, and/or a corrosion resistant layer. The multi-layer stack can enclose the rare earth magnet core, thereby protecting all surfaces of the rare earth magnet core.

Some embodiments of the disclosure are directed to a receiver magnet assembly that includes a magnet and a stack of layers disposed over the magnet. Embodiments are also directed to methods of making such magnet assemblies. According to some embodiments, the stack of layers includes, in order: a barrier metal layer, a catalyst layer, and a High Phosphorus Electroless Nickel (HiPEN) layer, where the Phosphorus content in the HiPEN layer is greater than 11% by weight.

In some embodiments, the stack of layers can further include a stress separation layer disposed between the barrier metal layer and the catalyst layer. As examples, the barrier metal layer can comprise a first transition metal, and the stress separation layer can comprise a second transition metal. In particular examples, the first transition metal can be zinc and the second transition metal can comprise copper. The magnet can comprise a rare earth metal, and in some embodiments can take the form of a NdFeB magnet. In some example, the catalyst layer can comprise palladium.

Some embodiments of the disclosure are directed to a receiver magnet assembly include a magnet having a stack of layers disposed over the magnet and at methods of making such magnet assemblies. According to some embodiments, the stack of layers disposed over the magnet can include, in order: a barrier metal layer, a metal alloy layer, and a metallic passivation layer. As examples, the barrier metal layer can comprise nickel, the metal alloy layer can comprise an alloy of nickel and zinc, and the metallic passivation layer can comprise chromium.

According to some embodiments, the stack of layers can include, in order: a first protective metallic layer, a second metallic layer different from the first protective metallic layer, the second metallic layer serving to reduce stress-induced corrosion, a catalyst layer, and a High Phosphorus Electroless Nickel (HiPEN) layer, wherein the Phosphorus content in the HiPEN layer is greater than 11% by weight. As examples, the first protective metallic layer can comprises nickel, the second metallic layer can comprise copper, and the catalyst layer can comprise semi-bright nickel.

DETAILED DESCRIPTION

Some embodiments of the disclosure pertain to methods of plating magnets with a stack of layers such that the resulting magnet assembly has improved corrosion resistance. The magnet in a receiver can corrode, causing total harmonic distortion (THD) or functional receiver failures. While some embodiments of the disclosure are particularly useful for improving corrosion resistance of receiver magnets while maintaining the receiver acoustic and drop performance, other embodiments can beneficially improve the corrosion resistance of magnets used in other applications or improve the corrosion resistance of other structures, such as electrical contacts. Embodiments also pertain to the assemblies formed by such methods themselves.

In some embodiments, a multi-layer stack of different materials is formed over a rare earth magnet (e.g. NdFeB) core. Although the explanation in the specification has been provided with NdFeB magnets as an example, methods described can be applicable to other kinds of magnets as well. The multi-layer stack can include one or more layers serving one or more functions. For example, layers can have properties tailored to act as a barrier layer, a catalyst, a scratch protection layer, a passivation layer, and/or a corrosion resistant layer.

Figure 1:
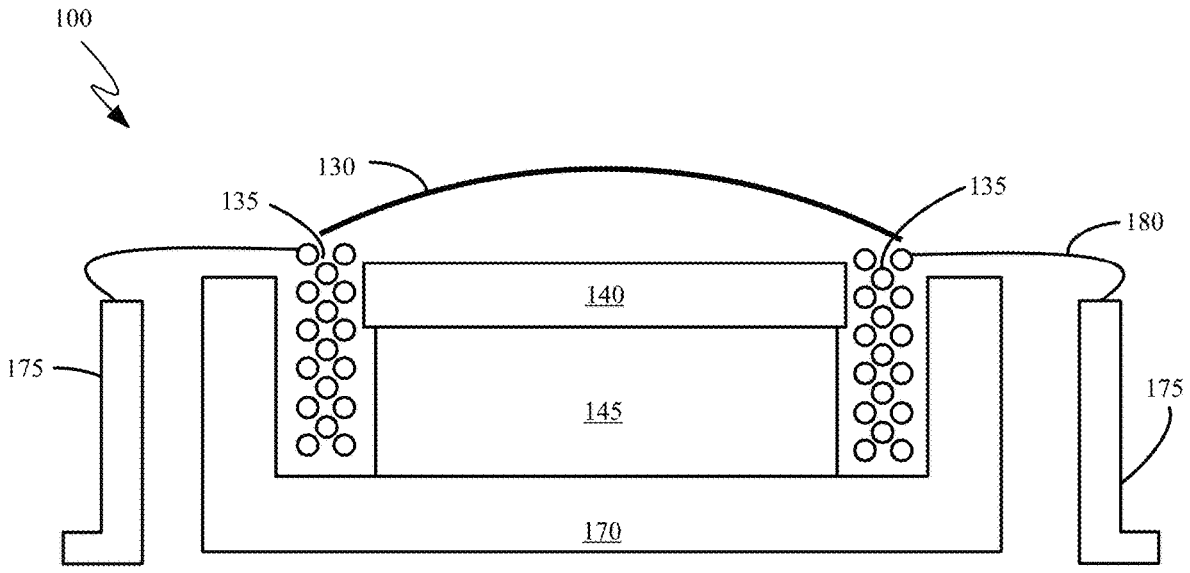
FIG. 1 is a simplified exploded view of an example receiver showing the location of a receiver magnet.

Embodiments of the disclosure can operate with one or more acoustic receivers that can be used, for example in a speaker of a mobile phone. FIG. 1 shows an exploded view of an exemplary acoustic receiver 100 illustrating the location of a magnet 145 within acoustic receiver 100.

As shown in FIG. 1, acoustic receiver 100 can include various components, such as a diaphragm 130, a voice coil 135, a magnet plate 140, a magnet 145, a yoke 170, springs 175, and connectors 180. Magnet 145, housed inside yoke 170 in some embodiments, can drive voice coils 135 to make receiver 100 work. In some embodiments, magnet 145 can comprise a rare earth magnet. For example, magnet 145 can be a neodymium-based magnet such as $Nd_2Fe_{14}B$, sometimes abbreviated NIB. Although explained here in the context of a receiver magnet, embodiments of the invention based on neodymium-based magnets can be used in other applications such as hard drives, cordless tools, and electric motors.

Neodymium-based magnets undergo undesirable amounts of corrosion when exposed to the atmosphere. Such corrosion can be rapid and can degrade the performance of the device they are part of, in this example, the receiver (and hence the speaker). As the magnet corrodes, it can lose mass and hence change in shape and size, thereby affecting the properties and performance of the speakers. When the volume of the magnet decreases, the amount of magnetic flux created by the magnet decreases, and can fall below the amount of magnetic flux for which the receiver was designed. This can adversely affect performance.

Furthermore, corrosion of the magnet can generate small particles which can end up interfering with other components in the receiver such as vibrating coils that go around the magnet (e.g., voice coil 135). These particles can make contact with the coils and create a rubbing or "hissing" noise.

Figure 2:
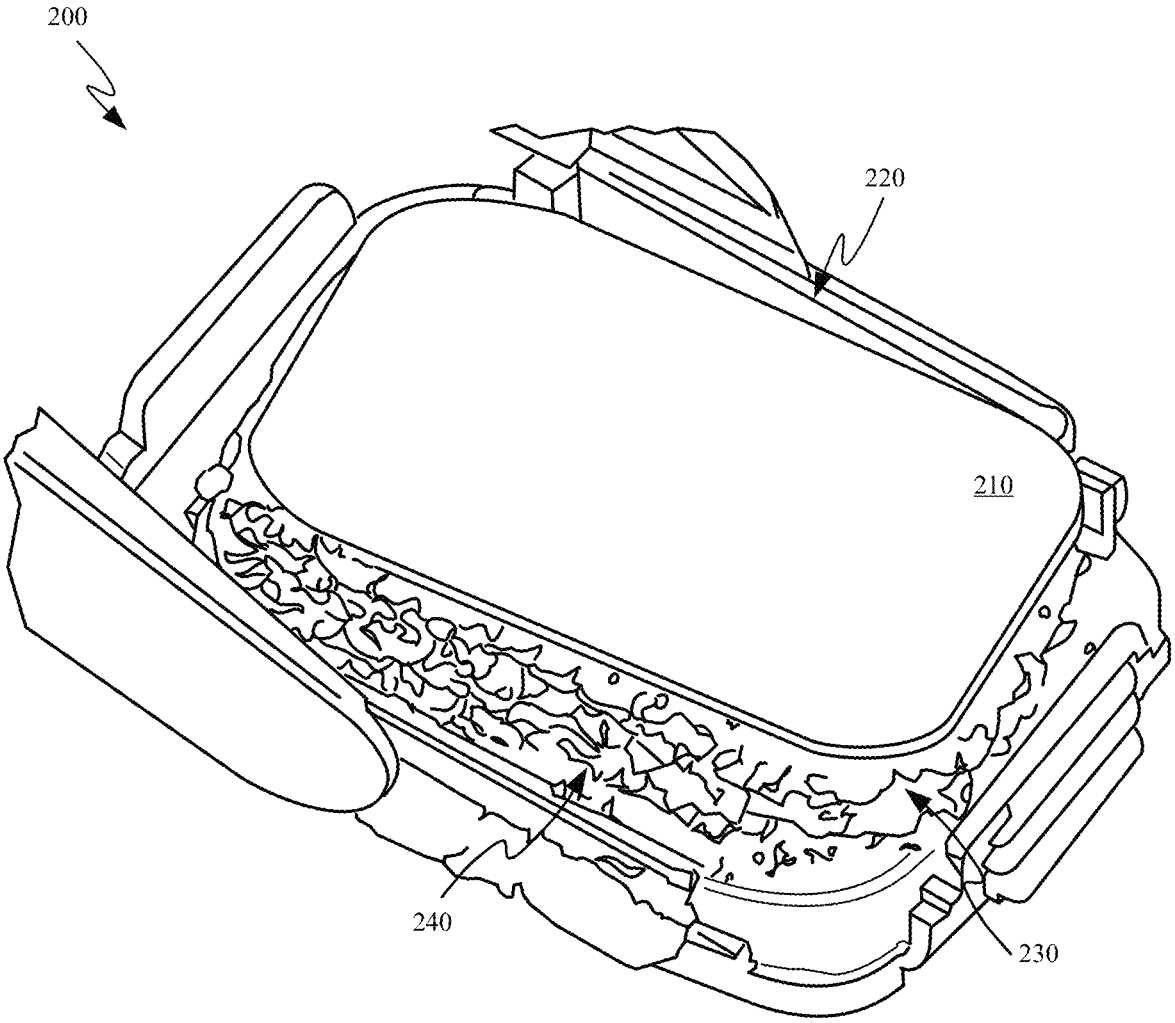
FIG. 2 is an illustration of a corroded receiver magnet displaced from its yoke.

FIG. 2 illustrates an example of a corroded magnet 210 of an acoustic receiver. As shown in FIG. 2, corrosion at the surfaces of magnet 210 is particularly clear along at corroded side surface 230 of magnet 210. Corroded side surface 230 can appear brownish-red because of the iron oxide buildup on the exterior of the magnet. The corrosion can also cause small particles to be formed around magnet 210. Magnet 210 can also lose mass and get displaced from yoke 220 as shown in FIG. 2, leaving gaps between the edge of magnet 210 and yoke 220, as illustrated by gap 240.

In general, corrosion of neodymium-based magnets can be accelerated in the presence of heat, moisture, and acidic environments. For the purposes of studying corrosion behavior of the magnets, corrosion can be accelerated through heat soak, salt spray, acetic acid heat soak, etc.

One way to reduce corrosion of magnets is through the use of one or more protective coatings formed over the magnet. Protective coatings can be of varying thicknesses and can take the form of single layer or multi-layer stacks. Such layers can be applied using several techniques including brush painting, dipping, spraying, electrophoresis, physical vapor deposition, ion vapor deposition, electroplating, electroless plating, and other suitable methods.

Figure 3A:
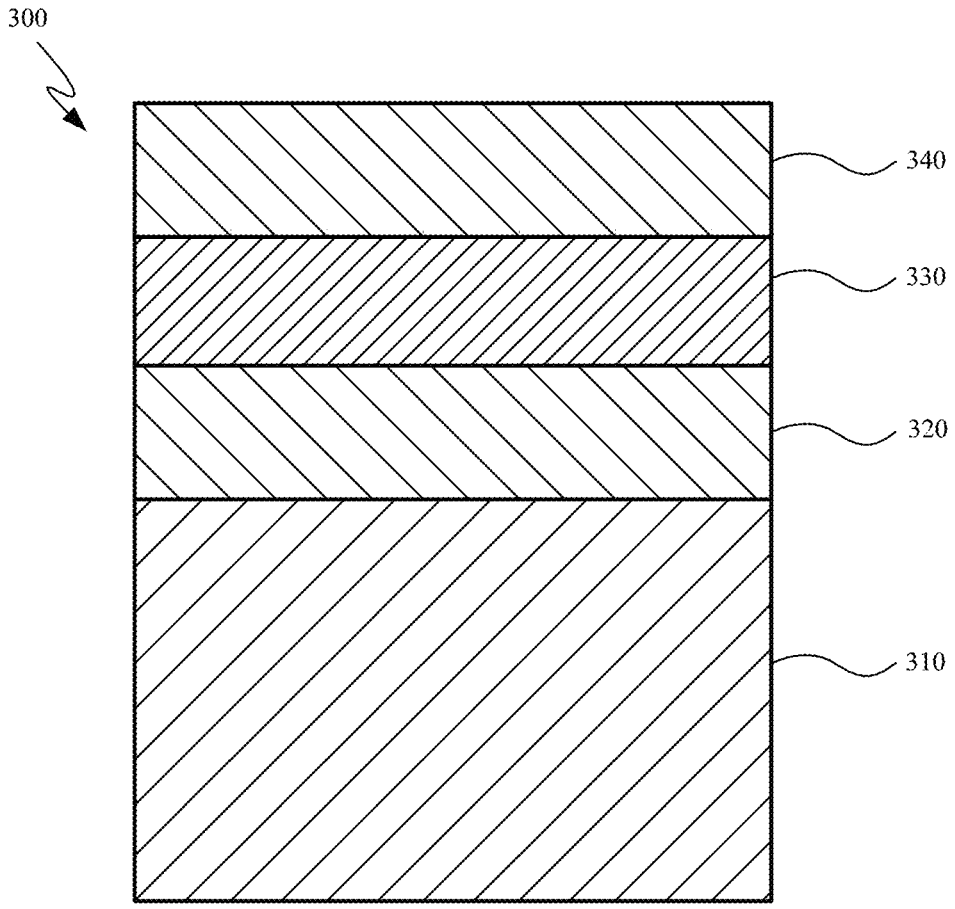
FIG. 3A is a simplified cross-sectional view of a magnet assembly with a nickel-copper-nickel stack formed over the magnet.
Figure 3B:
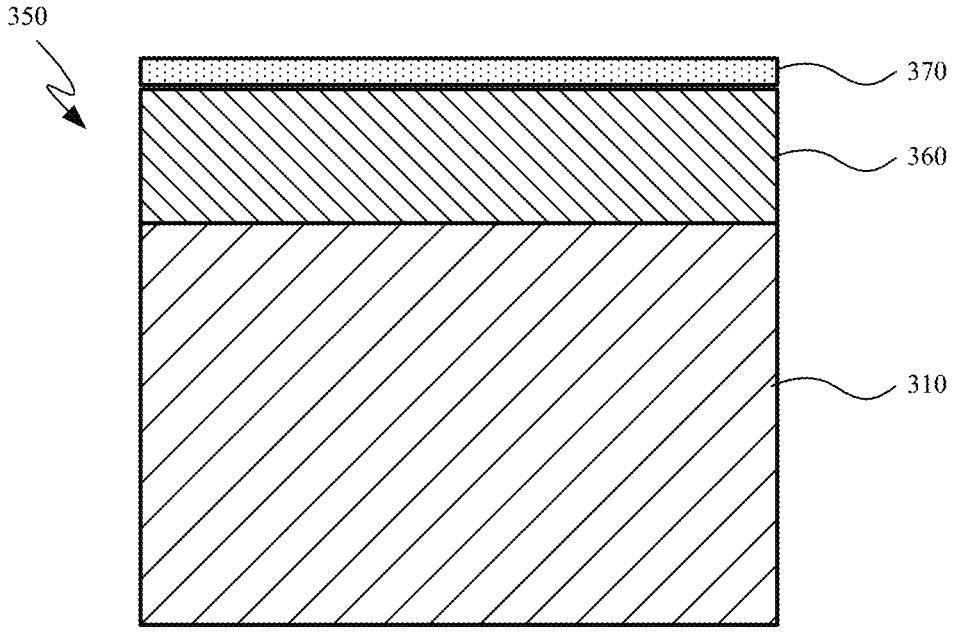
FIG. 3B is a simplified cross-sectional view of a magnet assembly with a zinc layer and a chromium passivation layer formed over the magnet.

Two examples of multi-layer layer stacks formed on a magnet 310 that impart some amount of corrosion resistance are shown in FIGS. 3A and 3B, which are simplified cross-sectional views of a magnet assembly 300 and a magnet assembly 350, respectively. Referring to FIG. 3A, magnet assembly 300 includes a magnet 310, a first nickel layer 320 formed over the magnet, a copper layer 330 formed over first nickel layer 320, and a second nickel layer 340 formed over copper layer 330. In embodiments, the thickness of first nickel layer 320 can be between 2 and 6 μm, the thickness of copper layer 330 can be between 2 and 5 μm, and the thickness of second nickel layer 340 can be between 2 and 6 μm. The three layers can be applied using electroplating and other suitable methods. Although nickel provides corrosion resistance, nickel is ferro-magnetic, interferes with the magnetic flux that magnet 310 produces, and can end up causing 'magnetic shorting' when the flux generated magnet 310 ends up getting stuck within first nickel layer 320.

Referring to FIG. 3B, magnet assembly 350 includes a magnet 310, a zinc layer 360, and a chromium passivation layer 370. Zinc layer 360 provides an initial layer of corrosion resistance to underlying magnet 310, and zinc, being non-magnetic, provides the advantage of not interfering with the magnetic flux generated by magnet 310. However, the corrosion resistance provided by zinc can prove to be inadequate under some conditions. To further improve corrosion resistance of magnet assembly 350, chromium passivation layer 370 is formed over zinc layer 360. In embodiments, the thickness of zinc layer 340 can be between 2 and 10 μm. Layers 360 and 370 can be applied using electroplating and other suitable methods.

In some embodiments, a high phosphorus nickel formed by electroless plating, or High Phosphorus Electroless Nickel (HiPEN) can be used for plating a magnet to improve the corrosion resistance of the magnet assembly. HiPEN offers the advantage of being non-magnetic because of its high phosphorus content, which allows HiPEN to impart corrosion resistance while simultaneously having minimal impact on magnetic performance. Preferably, a phosphorus content of greater than 11 percent by weight renders the HiPEN non-magnetic with a magnetic permeability of close to 1. The high phosphorus content also changes the microstructure of the nickel, making it more amorphous.

According to some embodiments of the disclosure, a layer of HiPEN can be formed over a magnet to make the assembly corrosion resistant. However, the process of electroless nickel plating can be slow. During the electroless nickel plating process, electroless nickel can get trapped inside cracks near the surface region of the NdFeB magnet causing blistering and corrosion. To reduce or prevent such blistering and/or corrosion, a barrier layer can be formed between the magnet and the electroless nickel layer as described below in conjunction with FIGS. 4 and 5.

Figure 4:
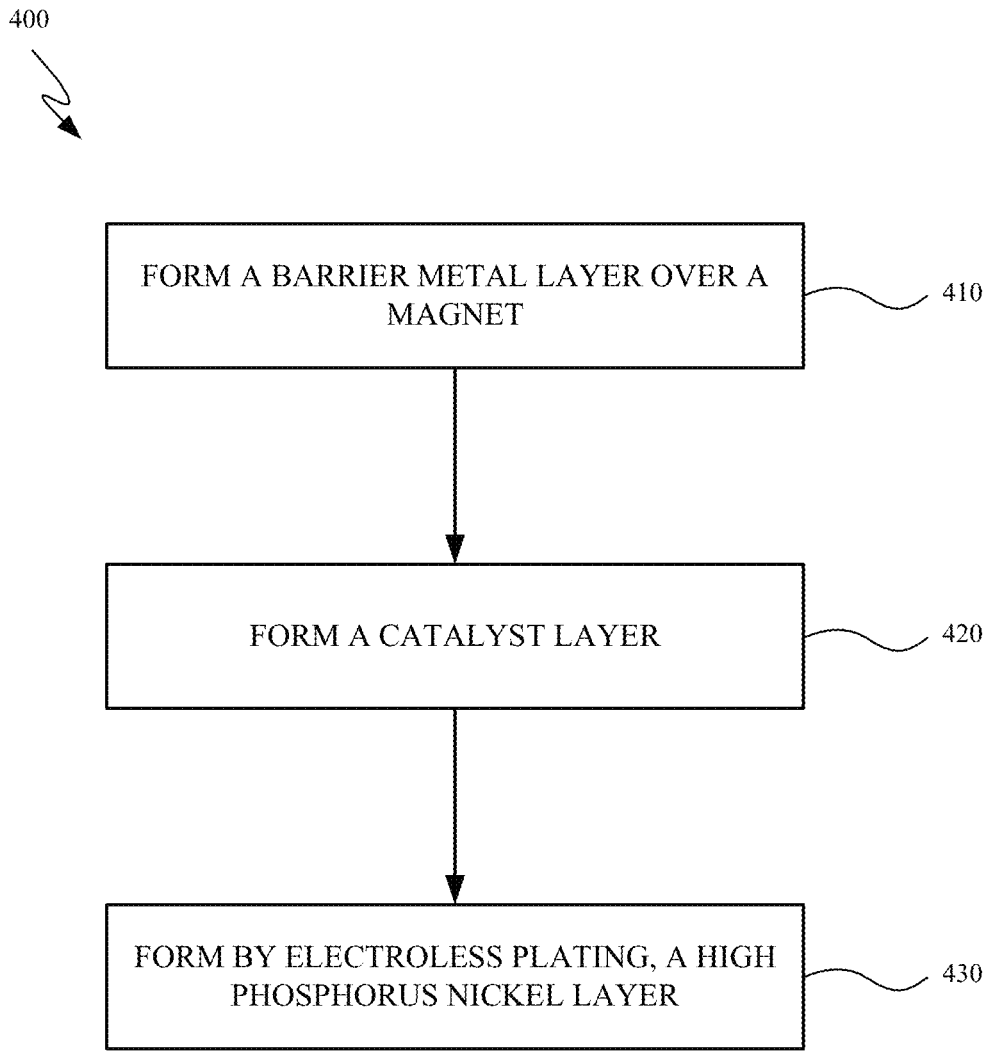
FIG. 4 is a flowchart of an example method of forming a corrosion-resistant magnet assembly according to some embodiments of the disclosure.
Figure 5:
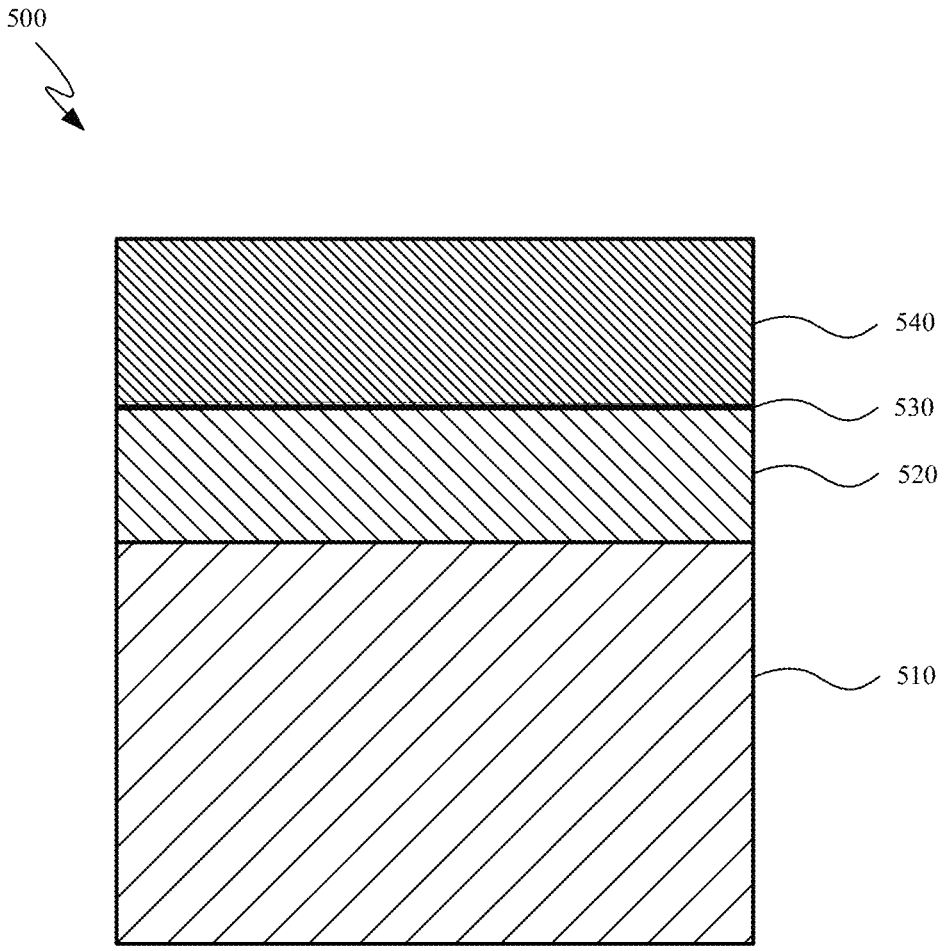
FIG. 5 is a simplified cross-sectional view of a magnet assembly with a stack of layers over a magnet, according to some embodiments of the disclosure.

FIG. 4 and FIG. 5 are directed to a method of forming a magnet assembly and the magnet assembly formed by such a method respectively, according to some embodiments of the invention. FIG. 4 is a flowchart illustrating an example of a process 400 that can be used to make magnet assembly 500 of FIG. 5, according to some embodiments. FIG. 5 is a magnet assembly formed by process 400, although processes other than process 400 can potentially be used to form magnet assembly 500. References will simultaneously be made to elements from FIG. 4 and FIG. 5 in the description below.

At block 410, process 400 includes forming a barrier metal layer 520 over a magnet 510. In some embodiments, barrier metal layer 520 can be or can include zinc. Zinc is diamagnetic and thus does not affect the magnetic flux from magnet 510. In other embodiments, barrier metal layer 520 can include other transition metals, such as aluminum copper, nickel, or cobalt. During the subsequent electroless nickel plating process (described further below with reference to block 430), barrier metal layer 520 can prevent the electroless nickel from attacking and corroding magnet 510. The thickness of barrier metal layer 520 can be tailored to ensure that subsequently deposited electroless nickel does not come in contact with the magnet. In some embodiments, the thickness of barrier metal layer 520 can be 2-4 μm.

Deposition of HiPEN on barrier metal layer 520 can be slow, thereby posing a risk of the HiPEN corroding barrier metal layer 520 during the HiPEN deposition process and eventually coming in contact with magnet 510. Such a risk can be reduced by using a thin catalyst layer over barrier metal layer 520 to speed up HiPEN deposition.

At block 420, process 400 includes forming a catalyst layer 530 over barrier metal layer 520. In examples, catalyst layer 530 can include a monolayer of palladium, formed by a palladium dip. Other examples of catalyst layer 530 can include semi-bright nickel. Catalyst layer 530 can increase the rate of subsequent HiPEN deposition, and thereby reduce the risk of HiPEN coming in contact with magnet 510 by corroding through barrier metal layer 520 during HiPEN deposition.

At block 430, process 400 includes forming a HiPEN layer 540 by electroless nickel plating. Unlike electroplating, in electroless nickel plating, it is not necessary to pass an electric current through the solution to form a deposit. Advantages of the Electroless Nickel (EN) process can include uniform deposition, and the ability to provide different kinds of finishes such as matte, bright, rough, or smooth. A relatively rough EN can help with adhesion to the yoke when the magnet assembly is sealed to the yoke using a glue. In some embodiments, the thickness of HiPEN layer 540 can be between 2 and 9 μm.

Layers formed over the magnet can be thin—on the order of a few microns—and hence prone to scratching from handling, both during and after the plating process. If the layers are very thin, even minor scratching can expose the underlying magnet. High volume production invariably involves handling and can cause scratching. A scratch resistant layer in the stack can be beneficial, for example, in such situations when used as a top surface. While the EN layer itself provides the advantage of scratch resistance when used as the top layer, a stress separation layer can be used to alleviate stress between the magnet and the outer layers.

Figure 6:
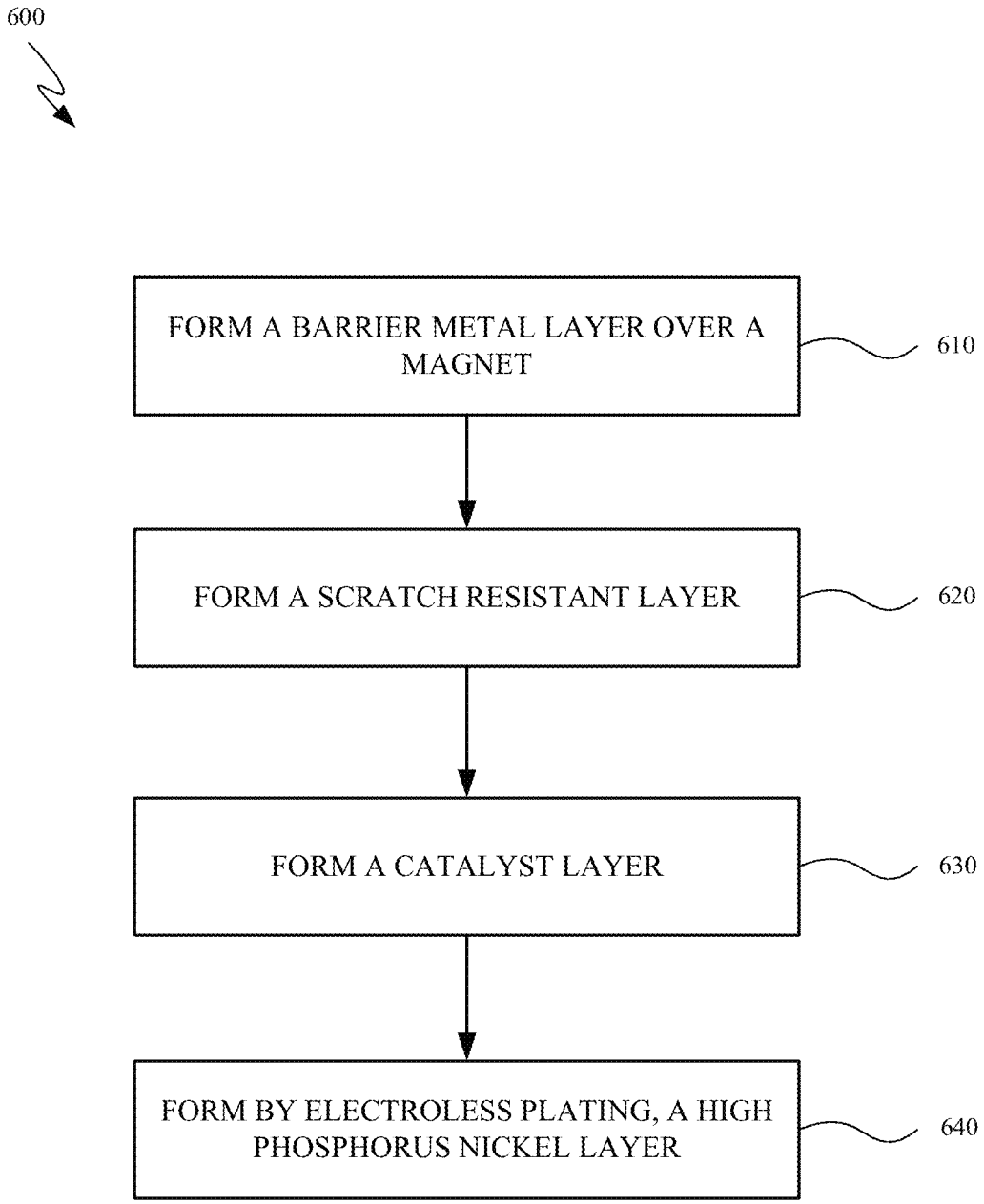
FIG. 6 is a flowchart of an example method of forming a corrosion-resistant magnet assembly according to some embodiments of the disclosure.
Figure 7:
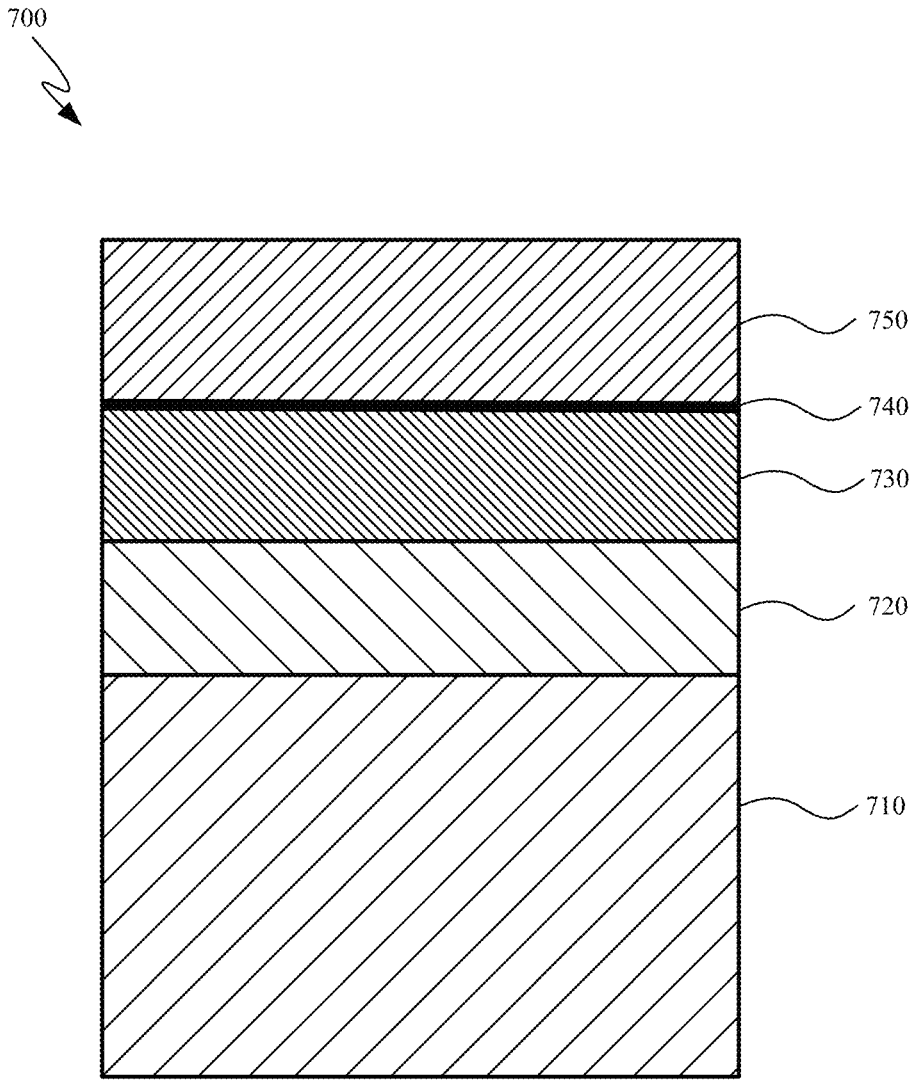
FIG. 7 is a simplified cross-sectional view of a magnet assembly with a stack of layers over a magnet, according to some embodiments of the disclosure.

FIG. 6 and FIG. 7 are directed to a method of forming a magnet assembly and the magnet assembly formed by such a method respectively, according to some embodiments of the disclosure. FIG. 6 is a flowchart illustrating an example of a process 600 that can be used to make magnet assembly 700 of FIG. 7, according to some embodiments. FIG. 7 is a magnet assembly formed by process 600, although processes other than process 600 can potentially be used to form magnet assembly 700. References will simultaneously be made to elements from FIG. 6 and FIG. 7 in the description below.

At block 610, process 600 includes forming a barrier metal layer 720 over a magnet 710. In some embodiments, barrier metal layer 720 can be or can include zinc. Zinc is diamagnetic and thus does not affect the magnetic flux from magnet 710. In other embodiments, barrier metal layer 720 can include other transition metals, such as aluminum, copper, nickel, and cobalt. The thickness of barrier metal layer 720 can be tailored to ensure that subsequently deposited electroless nickel does not come in contact with the magnet. In some embodiments, the thickness of barrier metal layer 720 can be 2-4 μm.

At block 620, process 600 includes forming a stress separation layer 730. In some embodiments, stress separation layer 730 can be or can include copper. Copper is also non-magnetic and does not interfere with the magnetic flux. In other examples, stress separation layer 730 can include other hard transition metals. The thickness of stress separation layer 730 can be tailored to ensure that the stack has an optimum thickness for alleviating stress. In some embodiments, the thickness of stress separation layer 730 can be 2-4 μm. Stress separation layer 730 can make magnet assembly 700 more suitable for high volume production.

At block 630, process 600 includes forming a catalyst layer 740 over stress separation layer 730. In examples, catalyst layer 740 can include a monolayer of palladium formed by a palladium dip. Other examples of catalyst layer 530 can include semi-bright nickel. Catalyst layer 740 can increase the rate of subsequent HiPEN deposition, and reduce the risk of HiPEN coming in contact with magnet 710.

At block 640, process 600 includes forming a HiPEN layer 750 by electroless nickel plating. Unlike electroplating, in electroless nickel plating, it is not necessary to pass an electric current through the solution to form a deposit. Advantages of the EN process can include uniform deposition, and ability to provide different kinds of finishes such as matte, bright, rough, or smooth. In some embodiments, the thickness of HiPEN layer 750 can be between 6-9 μm.

Figure 8:
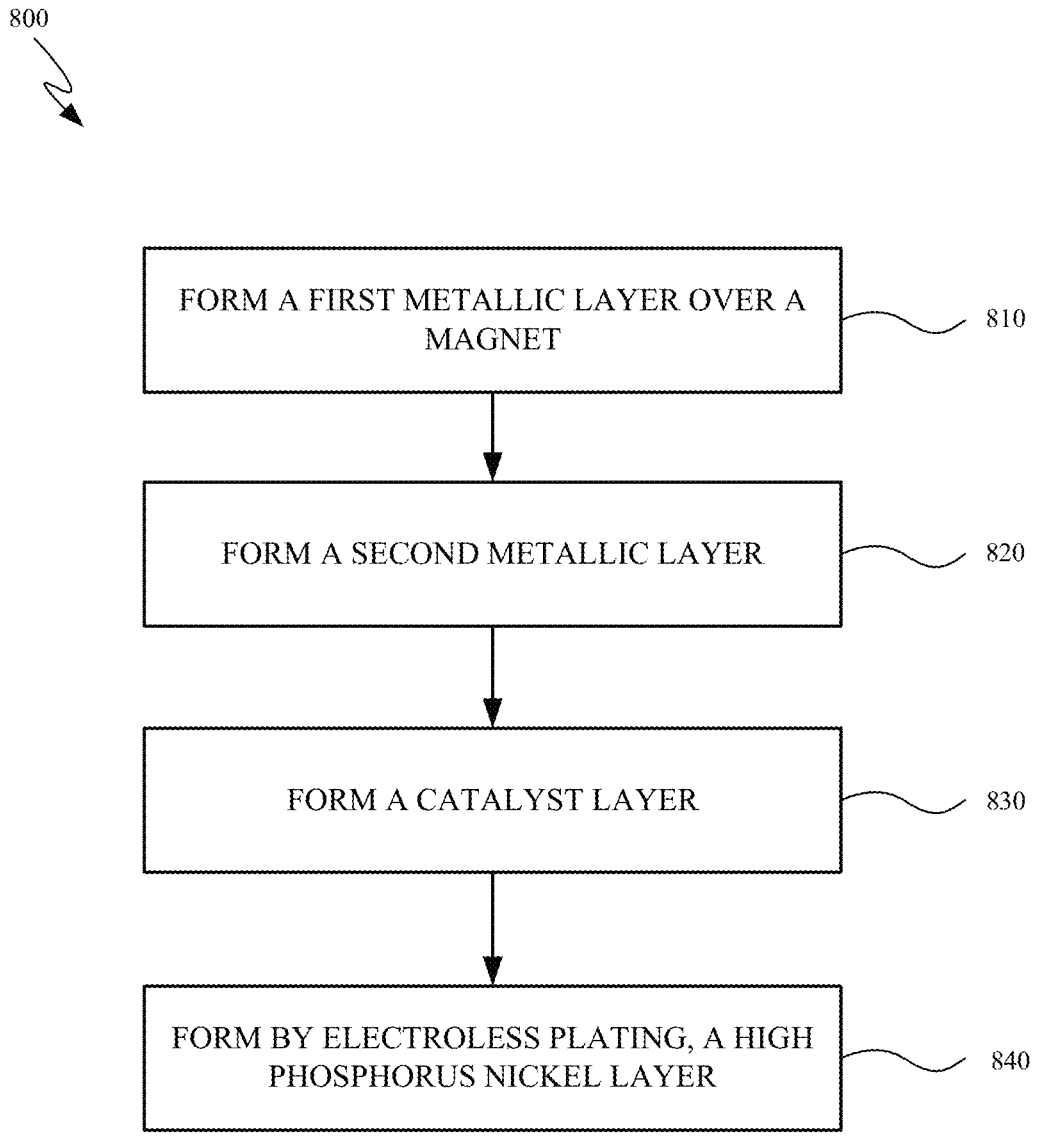
FIG. 8 is a flowchart of an example method of forming a corrosion-resistant magnet assembly according to some embodiments of the disclosure.
Figure 9:
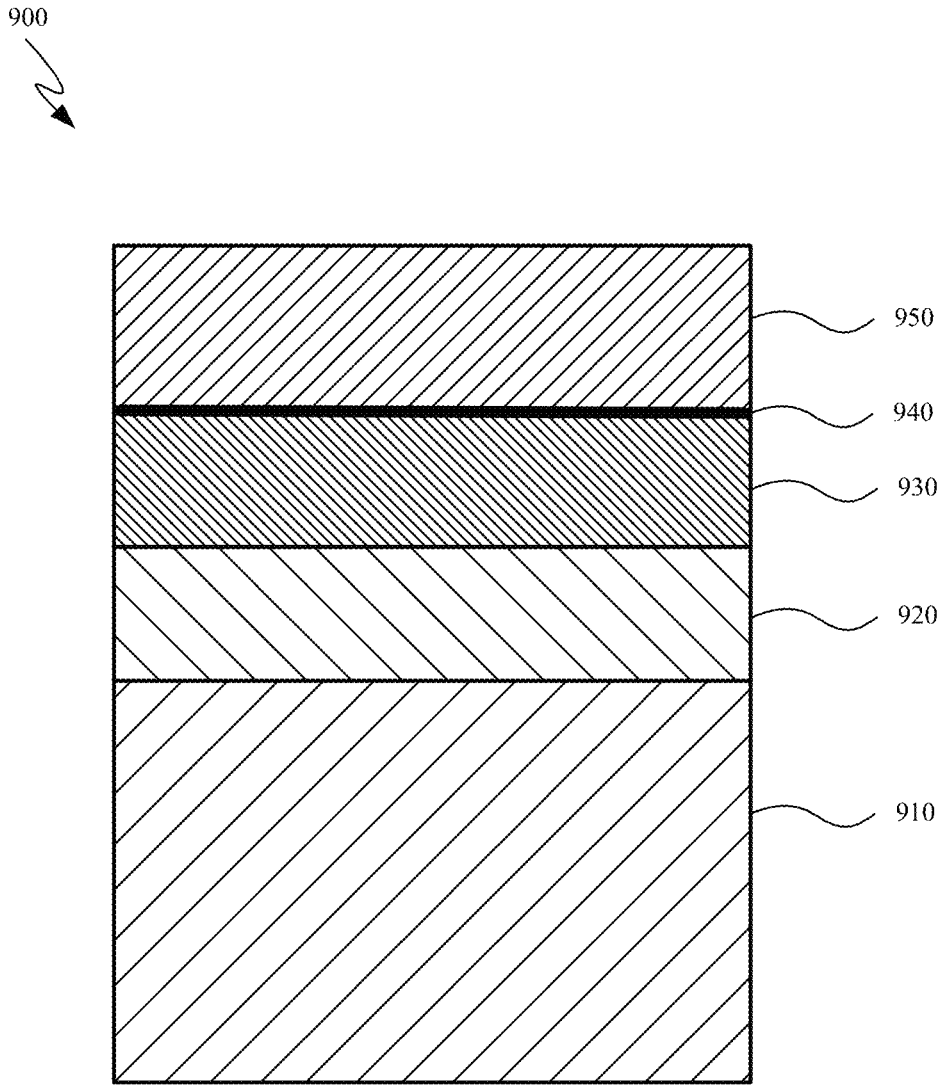
FIG. 9 is a simplified cross-sectional view of a magnet assembly with a stack of layers over a magnet, according to some embodiments of the disclosure.

FIG. 8 and FIG. 9 are directed to a method of forming a magnet assembly and the magnet assembly formed by such a method respectively, according to some embodiments of the disclosure. FIG. 8 is a flowchart illustrating an example of a process 800 that can be used to make magnet assembly 900 of FIG. 9, according to some embodiments. Process 800 can be used in mass production of plating stacks. FIG. 9 is a magnet assembly formed by process 800, although processes other than process 800 can potentially be used to form magnet assembly 900. References will simultaneously be made to elements from FIG. 8 and FIG. 9 in the description below.

At block 810, process 800 includes forming a first protective metallic layer 920 over a magnet 910. First protective metallic layer 920 can be formed using several techniques such as dipping, spraying, and other suitable methods. In some embodiments, first protective metallic layer 920 can be or can include nickel. Nickel diffuses into the boundaries of the magnet surface region holds the magnet's structure, and prevents cracks from propagating. In some embodiments, the thickness of first protective metallic layer 920 can be between 3 and 4 μm.

At block 820, process 800 includes forming a second metallic layer 930. Second metallic layer 930 can help to reduce stress extending from the substrate, thereby minimizing stress-induced corrosion. Second metallic layer 930 can also prevent further magnetic shorting between first protective metallic layer 920, and layers deposited over second metallic layer 930. In some embodiments, second metallic layer 930 can be or can include copper. In some embodiments, the thickness of second metallic layer 930 can be 2-4 μm.

At block 830, process 800 includes forming a catalyst layer 940. In examples, catalyst layer 940 can include semi-bright nickel. In some embodiments, semi-bright nickel can be used in place of, or in addition to, the more expensive palladium dip. Semi-bright nickel can have less grain refiner, which can result in larger nickel grains. This can create a rougher surface that promotes better plating adhesion. In some embodiments, ~1 μm of semi-bright nickel can be used. Catalyst layer 940 can increase the rate of subsequent HiPEN deposition.

At block 840, process 800 includes forming a HiPEN layer 950 by electroless nickel plating. Unlike electroplating, in electroless nickel plating, it is not necessary to pass an electric current through the solution to form a deposit. Advantages of the EN process can include uniform deposition, corrosion and scratch resistance, and ability to provide different kinds of finishes such as matte, bright, rough, or smooth. When compared to several other materials, a relatively thinner EN layer can provide the required corrosion and scratch resistance. This can allow for a bigger magnet for the same overall thickness of the magnet assembly. In some embodiments, the thickness of HiPEN layer 950 can be between 2-3 μm.

In some embodiments, a metal alloy layer, such as zinc-nickel alloy layer, can be used in the stack for corrosion resistance. A metal alloy layer can provide the advantage of easy manufacturability.

Figure 10:
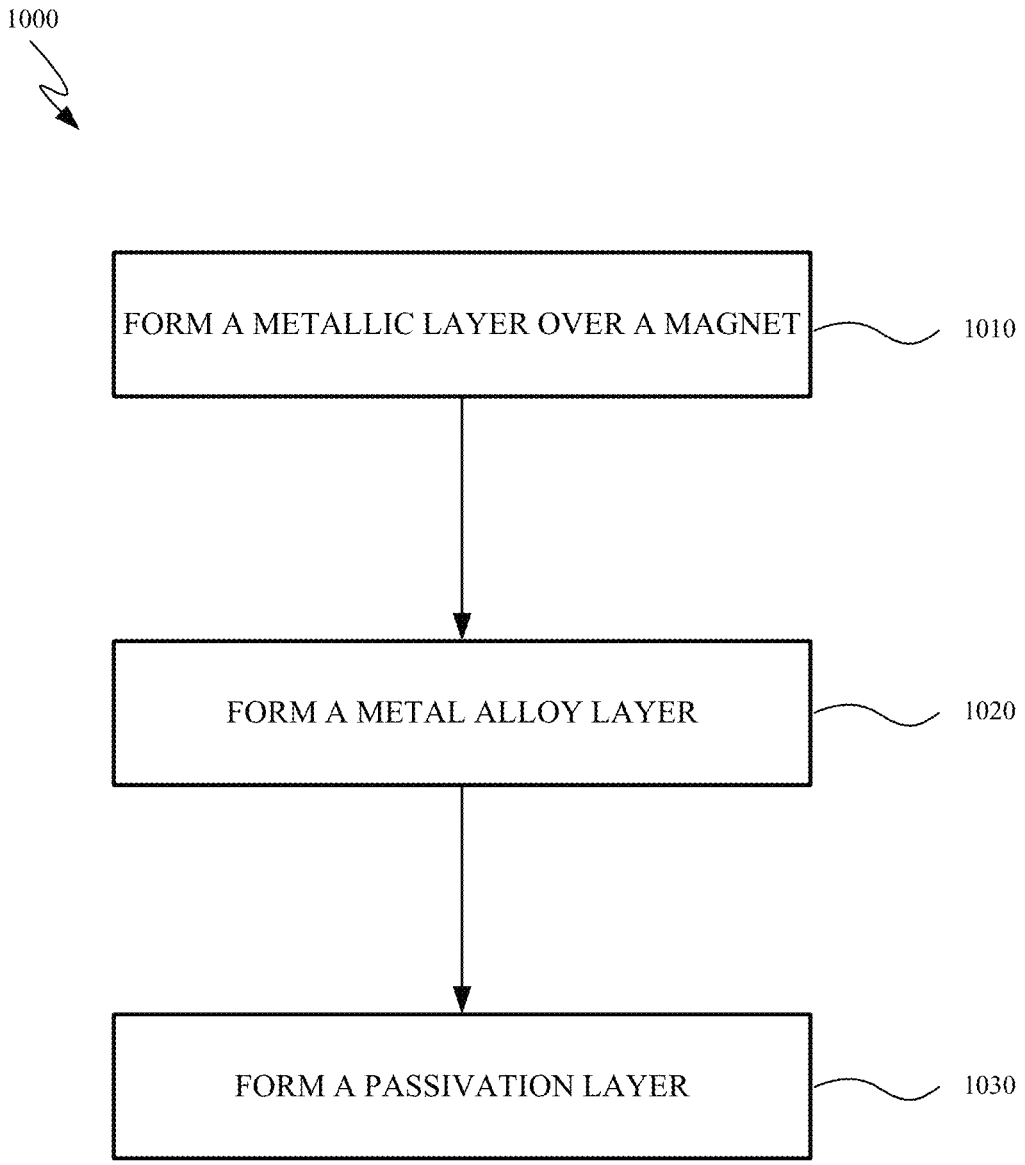
FIG. 10 is a flowchart of an example method of forming a corrosion-resistant magnet assembly according to some embodiments of the disclosure.
Figure 11:
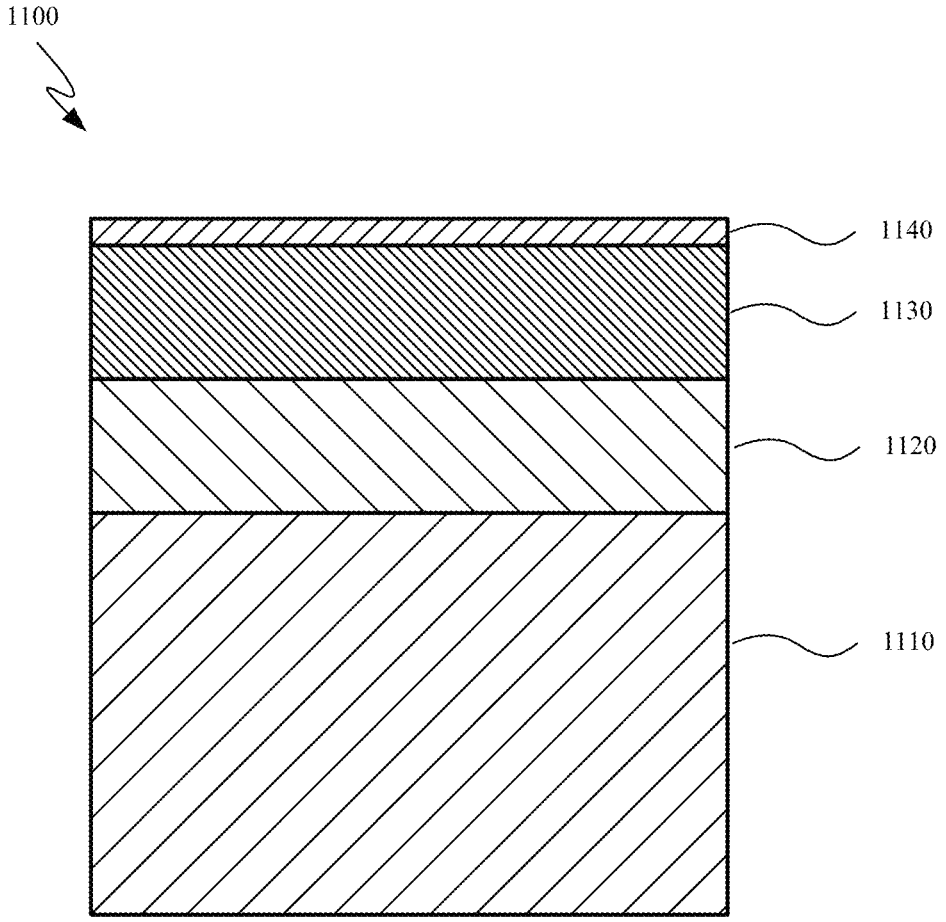
FIG. 11 is a simplified cross-sectional view of a magnet assembly with a stack of layers over a magnet, according to some embodiments of the disclosure.

FIG. 10 and FIG. 11 are directed to a method of forming a magnet assembly and the magnet assembly formed by such a method respectively, according to some embodiments of the disclosure. FIG. 10 is a flowchart illustrating an example of a process 1000 that can be used to make magnet assembly 1100 of FIG. 11, according to some embodiments. FIG. 11 is a magnet assembly formed by process 1000, although processes other than process 1000 can potentially be used to form magnet assembly 1100. References will simultaneously be made to elements from FIG. 10 and FIG. 11 in the description below.

At block 1010, process 1000 includes forming a barrier metal layer 1120 over a magnet 1110. Barrier metal layer 1120 can be formed using several techniques such as dipping, spraying, and other suitable methods. In some embodiments, barrier metal layer 1120 can be or can include zinc. In some embodiments, the thickness of barrier metal layer 1120 can be between 2 and 4 μm.

At block 1020, process 1000 includes forming a metal alloy layer 1130. In some embodiments, metal alloy layer 1130 can include an alloy of zinc and nickel. In such embodiments, the metal alloy layer can have the combined advantages of corrosion resistance from nickel and diamagnetism from zinc. The percentage of nickel and zinc in such an alloy can be tailored based on the desired properties. For example, the percentage of zinc by weight can be between 3 and 30%. In some embodiments, the alloy of zinc and nickel can be electroplated using a plating solution of zinc and nickel ions. In some embodiments, the thickness of metal alloy layer 1130 can be 8-12 μm.

At block 1030, process 1000 includes forming a passivation layer 1140. In examples, passivation layer 1140 can include metallic chromium.

Figure 12:
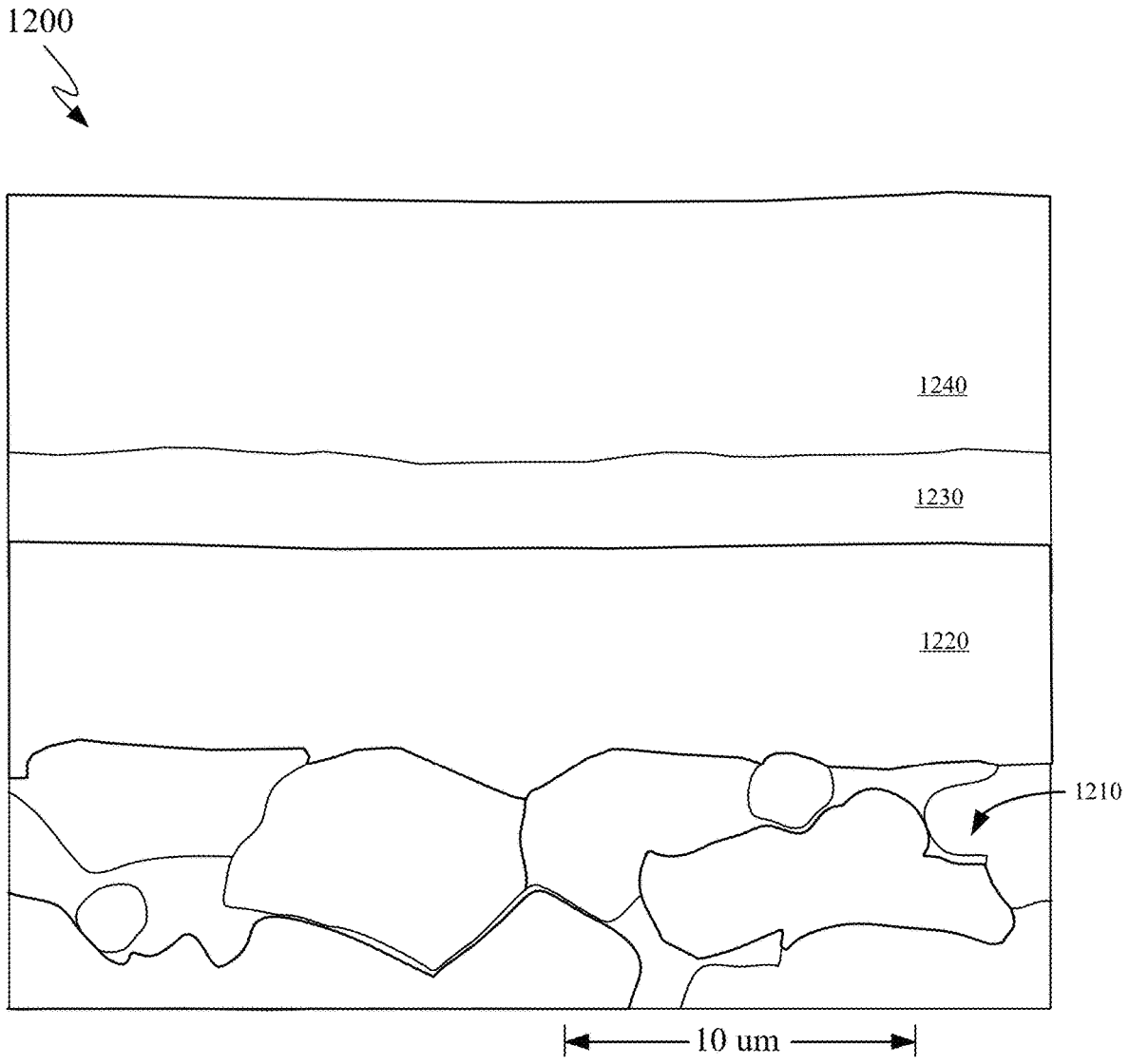
FIG. 12 is a cross section micrograph of the stack of layers from a magnet assembly formed according to embodiments of the disclosure.

FIG. 12 is a Scanning Electron Microscope cross-section 1200 of the tack of layers from a magnet assembly formed according to some embodiments of the disclosure. The magnet assembly shown in FIG. 12 can be formed according to methods of FIG. 6. Cross-section 1200 depicts a magnet 1210, a barrier metal layer (zinc) 1220, a stress separation layer (copper) 1230, and a HiPEN layer 1240.

Methods described above can be used in several components in computing and other devices where magnets are used. Examples of such components can include audio receivers, speakers, cameras, wireless chargers, wearable devices, and other suitable methods. Methods described above and magnet assemblies formed by such methods can impart significant corrosion resistance and prevent various kinds of failures in the components.

In some embodiments, methods and systems as described above can be used to form corrosion-resistant features that do not include magnets. For example, methods and apparatuses described above can be used for form corrosion-resistant electrical contacts. Such contacts can be used in consumer electronic equipment such as smart phones, tablets, and laptop computers. In some examples, a contact made of a copper-alloy such as phosphor bronze can be clad with a Precious Metal Alloy (PMA). The PMA can further be coated with a corrosion-resistant stack, such as stacks formed on a magnet described above with reference to FIGS. 4-11.

Figure 13:
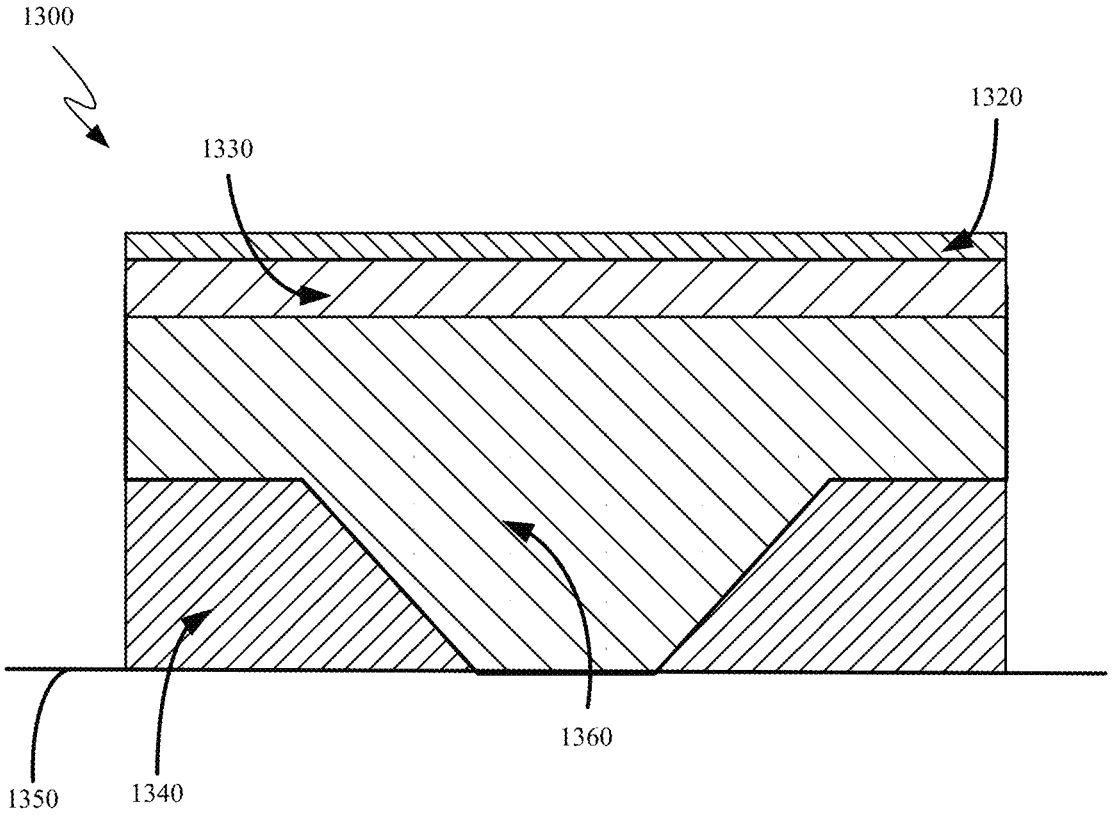
FIG. 13 is a simplified cross-section of a corrosion-resistant electrical contact, formed according to embodiments of the disclosure.

FIG. 13 is a simplified cross-section of a corrosion-resistant contact 1300 formed according to some embodiments. As shown in FIG. 13, contact body 1360 can be made of a metal or metal alloy such as copper or phosphor bronze. Contact 1300 makes contact to substrate 1350 in the contact area 1360, and is electrically separated from adjacent features by a dielectric 1340. In some embodiments, dielectric 1340 can be an air gap. On the side of contact 1300 that is exposed to the environment, a layer of Precious Metal Alloy (PMA) 1330 is formed. In some embodiments, PMA layer 1330 can include Paliney 7, a palladium, silver age-hardenable alloy that contains 10% gold and 10% platinum having a high resistance to corrosion and tarnish while providing the mechanical properties of Beryllium Copper. Over PMA layer 1330, contact 1300 includes a corrosion resistant layer 1320. In some embodiments, corrosion resistant layer can be made of a stack of layers. In one example, the stack of layers can include layers 520, 530, and 540 of FIG. 5, in that order, with layer 520 disposed nearest to PMA layer 1330. In another example, the stack of layers can include layers 720, 730, 740, and 750 of FIG. 7 in that order, with layer 720 disposed nearest PMA layer 1330. In yet another example, the stack of layers can include layers 920, 930, 940, and 950 of FIG. 9 in that order, with layer 920 disposed nearest to PMA layer 1330. In yet another example, the stack of layers can include layers 1120, 1130, and 1140 of FIG. 11 in that order, with layer 1120 disposed nearest to PMA layer 1330.

Processes such as those described in FIGS. 4, 6, 8, 10 can be used to form layers of corrosion resistant layer 1330.

The foregoing description, for purposes of explanation, used specific nomenclature to provide a thorough understanding of the described embodiments. However, it will be apparent to one skilled in the art that the specific details are not required in order to practice the described embodiments. For example, while several specific embodiments of the disclosure described above use neodymium-based receiver magnets, the disclosure is not limited to any particular kind of magnet. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A receiver magnet assembly comprising:
a magnet; and
a stack of layers disposed over the magnet comprising, in order:
a barrier metal layer;
a catalyst layer comprising palladium or semi-bright nickel; and
a High Phosphorus Electroless Nickel (HiPEN) layer having Phosphorus content that is greater than 11% by weight, wherein the HiPEN layer is the outermost layer of the receiver magnet.

2. The receiver magnet assembly of claim 1 further comprising a stress separation layer disposed between the barrier metal layer and the catalyst layer.

3. The receiver magnet assembly of claim 2, wherein the barrier metal layer comprises a first transition metal, and the stress separation layer comprises a second transition metal different from the first transition metal.

4. The receiver magnet assembly of claim 3, wherein the first transition metal is zinc, the second transition metal is copper.

5. The receiver magnet assembly of claim 1, wherein the magnet is a rare earth magnet.

6. The receiver magnet assembly of claim 1, wherein the catalyst layer comprises a monolayer of palladium.

7. The receiver magnet assembly of claim 1, wherein the stack of layers encloses the magnet.

8. The receiver magnet assembly of claim 1, wherein the catalyst layer increases the deposition rate of the HiPEN layer.

9. A receiver magnet assembly, comprising:
a magnet; and
a stack of layers disposed over the magnet comprising, in order:
a barrier metal layer;
a metal alloy layer;
a metallic passivation layer comprising palladium or semi-bright nickel; and
a High Phosphorus Electroless Nickel (HiPEN) layer having Phosphorus content that is greater than 11% by weight, wherein the HiPEN layer is the outermost layer of the receiver magnet.

10. The receiver magnet assembly of claim 9 wherein the barrier metal layer comprises nickel, the metal alloy layer comprises nickel and zinc, and the metallic passivation layer comprises chromium.

11. The receiver magnet assembly of claim 9, wherein the metallic passivation layer increases a scratch resistance of the stack of layers.

12. The receiver magnet assembly of claim 9 wherein the magnet is a rare earth magnet.

13. The receiver magnet assembly of claim 9, wherein the stack of layers encloses the magnet.

14. The receiver magnet assembly of claim 9, wherein the barrier metal layer comprises a first transition metal and the stack of layers further comprises a stress separation layer comprising a second transition metal different from the first transition metal.

15. A receiver magnet assembly comprising:
a magnet; and
a stack of layers disposed over the magnet comprising, in order:
a first metallic layer;
a second metallic layer different from the first metallic layer, the second metallic layer serving to reduce stress-induced corrosion;
a catalyst layer comprising palladium or semi-bright nickel; and
a High Phosphorus Electroless Nickel (HiPEN) layer having Phosphorus content that is greater than 11% by weight, wherein the HiPEN layer forms an exterior surface of the magnet assembly.

16. The receiver magnet assembly of claim 15 wherein the first metallic layer comprises nickel, the second metallic layer comprises copper, and the catalyst layer comprises semi-bright nickel.

17. The receiver magnet assembly of claim 15 wherein the magnet is a rare earth magnet.

18. The receiver magnet assembly of claim 15 wherein the stack of layers further comprises a metallic passivation layer that comprises chromium.

19. The receiver magnet assembly of claim 15,
wherein the receiver magnet is mounted in a yoke of an acoustic receiver.

20. The receiver magnet assembly of claim 15, wherein the catalyst layer increases the deposition rate of the HiPEN layer.

* * * * *